US006501915B2

(12) United States Patent
Yamashita

(10) Patent No.: US 6,501,915 B2
(45) **Date of Patent: *Dec. 31, 2002**

(54) IMAGE FORMING APPARATUS HAVING DETECTION ELECTRODE OUTSIDE DEVELOPING THEREOF

(75) Inventor: Hidetoshi Yamashita, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/757,621

(22) Filed: Jan. 11, 2001

(65) Prior Publication Data

US 2001/0019667 A1 Sep. 6, 2001

(30) Foreign Application Priority Data

Jan. 13, 2000 (JP) ..... 2000-010036

(51) Int. Cl.[7] ..... G03G 15/08; G03G 15/01
(52) U.S. Cl. ..... 399/27; 399/227
(58) Field of Search ..... 399/27, 30, 61, 399/62, 227; 73/304 C

(56) References Cited

U.S. PATENT DOCUMENTS 5,465,619 A * 11/1995 Sotack et al. ..... 73/304 C
5,617,188 A * 4/1997 Inomata ..... 399/30 X
5,987,269 A * 11/1999 Allen et al. ..... 399/27
6,275,665 B1 * 8/2001 Miyashiro ..... 399/27
6,314,250 B1 * 11/2001 Miyashiro ..... 399/27

FOREIGN PATENT DOCUMENTS

JP 11-184235 * 7/1999

* cited by examiner

*Primary Examiner*—Sandra Brase
(74) *Attorney, Agent, or Firm*—Fitzpatrick, Cella, Harper & Scinto

(57) ABSTRACT

An image forming apparatus includes an image bearer bearing a static image and an exchangeable type developing apparatus for developing the static image on the image bearer. The developing apparatus includes a developing chamber having a developing roller in an opening opposite to the image bearer, and a containing chamber containing a developer to be supplied to the developing chamber. A detection electrode is disposed outside the developing device and in which a voltage is induced. A detection device detects an amount of the developer in the containing chamber on the basis of an induced voltage in the detection electrode.

2 Claims, 6 Drawing Sheets

IMAGE FORMING APPARATUS HAVING DETECTION ELECTRODE OUTSIDE DEVELOPING THEREOF

BACKGROUND OF THE INVENTION

1. Field of the Invention

The present invention relates to an image forming apparatus such as a copier, printer, and the like using an electrophotographic system or a static recording system.

2. Related Background Art

In the image forming apparatus using an electrophotographic system, for example, a static latent image is formed on a surface of a photosensitive drum or a photosensitive belt, which is an image bearer, and the static image on the image bearer is developed by a developer, such as toner, to visualize an image as a toner image. The developed image is transferred to a transferring material by a transferring apparatus, to cause the toner image to be borne by the transferring material, and the toner image is fixed to the transferring material by heating and pressing by a fixing apparatus. By sequentially carrying out these steps, the image is formed.

Meanwhile, toner is consumed as the image forming apparatus is used and hence, a user should supply toner. Known methods for supplying toner include charging only toner in the image forming apparatus, replacing the developing apparatus including a toner container, or replacing a unit including the photosensitive drum.

There are methods for detecting of the amount of unused toner to inform the user of the time to replace toner. Conventional methods for residual toner detection are as follows.

In developing the static latent image formed on the image bearer by powder toner, toner is adsorbed and transferred by a static force. Toner is previously magnetized and then an electrostatic force is applied to the developing roller in the developing apparatus caused by a voltage difference to cause the toner to be adsorbed to the surface of the developing roller. The developing roller is disposed opposite to the image bearer and an electrostatic force stronger than that of the developing roller is applied to the image bearer. Then, toner is transferred and adsorbed from the developing roller to the image bearer and the latent image on the image bearer is visualized by toner.

Thus, the method for detecting a residual toner amount employs the voltage to be applied to the developing roller. Voltage is applied to the developing roller in order to adsorb and transfer toner as described above and the voltage and the electrostatic force are effective to all radial directions of the developing roller. For example, when an antenna, which is made of a conductive material is disposed in a position distant from the developing roller, an electric charge is generated in the antenna side by an electric potential difference. Hence, if toner which is a dielectric material exists between the developing roller and the antenna, the electric charge changes compared with absence of toner. As the amount of toner differs, the magnitude of the electric charge also differs and thus, the residual amount of toner can be detected by measuring the electric potential according to the electric charge to know relative comparison with the amount of toner.

However, there are problems in the conventional residual toner detection method as follows.

As shown in FIG. 4, the antenna 30 for measurement of the electric charge is disposed in the toner container 31 and thus, disturbs replacement of the toner container 31 (or, the developing apparatus or a process cartridge) for toner supply. In FIG. 4, a reference numeral 6 denotes a drum unit having a photosensitive drum 1.

In addition, as shown in FIG. 5, a contact 34 of antenna side in the toner container 31 should be attached to and detached from a contact 35 of main body side of the image forming apparatus. However, the conventional residual toner detection method is the detection method by measuring a micro voltage and therefore, a low reliability of the contact point does not allow for detection of a correct residual toner amount. Particularly, in a color image forming apparatus, as shown in FIG. 6, having a plurality of developing apparatus 4BK, 4Y, 4M, and 4C, antennas 30BK, 30Y, 30M, and 30C are disposed in developing apparatus 4BK, 4Y, 4M, and 4C, respectively, and hence, the increased number of the contact points results in lower reliability of the image forming apparatus and also a plurality of 30BK, 30Y, 30M, and 30C are necessary and hence, the cost increases. For information, in FIG. 6, the reference numeral 6 denotes a photosensitive drum unit having a photosensitive drum 1.

SUMMARY OF THE INVENTION

An object of the present invention is to provide an image forming apparatus of high reliability of the contact point for detecting an amount of the developer.

Another object of the present invention is to provide an image forming apparatus comprising: an image bearer for bearing a static image; an exchangeable type developing for developer the static image on the image bearer, the developing apparatus comprising, a developing chamber having a developing roller in an opening opposite to the image bearer, and a containing chamber for containing a developer to be supplied to the developing chamber; a detection electrode disposed outside the developing apparatus and in which a voltage is induced; and detection means for detecting an amount of the developer in the containing chamber on the basis of an induced voltage of the detection electrode.

Further objects of the present invention will be apparent from the following description.

DESCRIPTION OF THE PREFERRED EMBODIMENTS

Embodiments of the present invention will be described below with reference to the drawings attached herewith.

Figure 1:
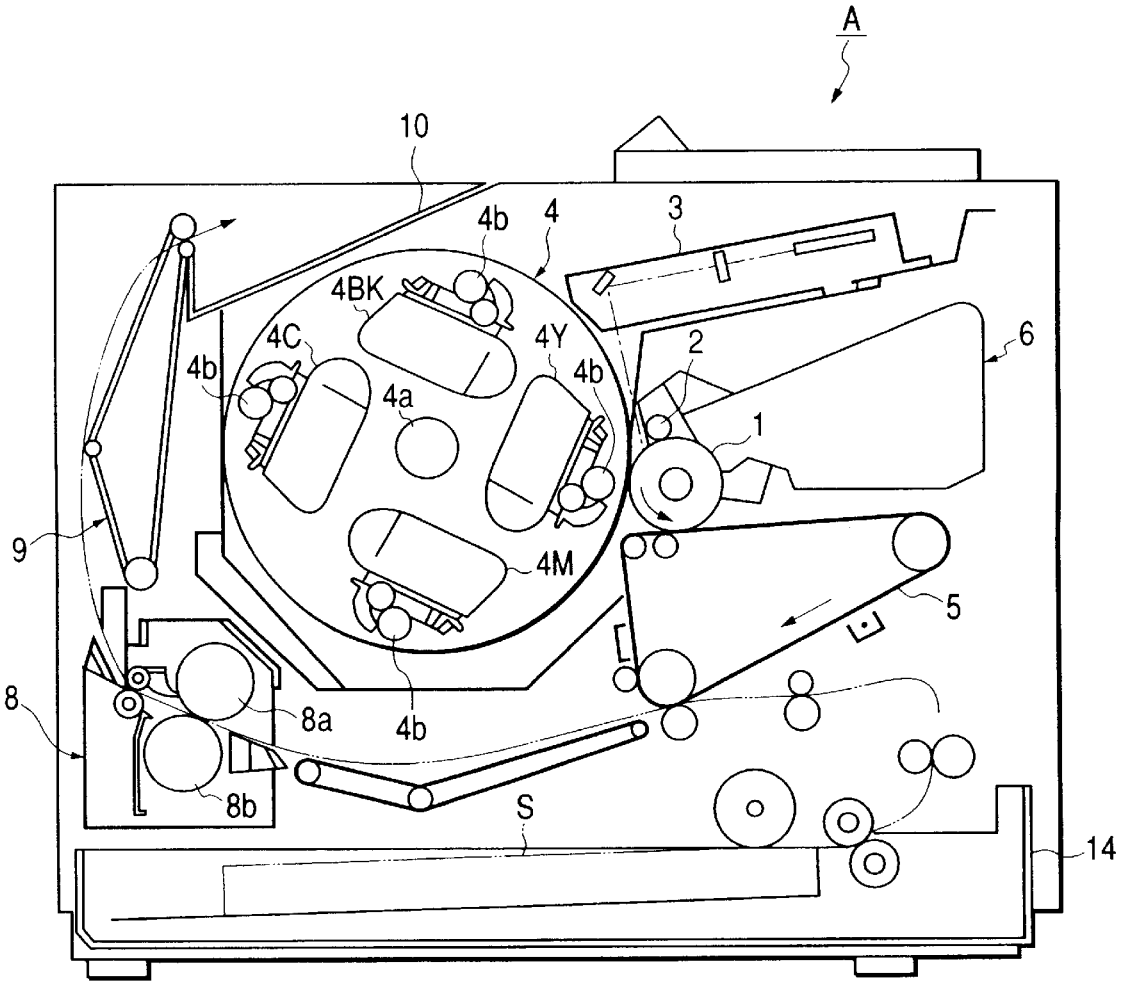
FIG. 1 is a sectional view of an image forming apparatus (a laser beam printer) according to the present invention.

FIG. 1 is the sectional view of the laser beam printer as an embodiment of the image forming apparatus, according to the present invention using electrophotography and the laser beam printer can form a tetrachromatic full-color image.

The image forming apparatus A, which forms image by fixing an image visualized by the developing to the transfer material by heating, comprises a photosensitive drum 1 which is an electrophotographic photosensitive member of a drum type as a first image bearer. The photosensitive drum 1 is incorporated into the photosensitive drum unit 6 and rotatively driven by driving means, not illustrated, in a direction (counterclockwise) of an arrow illustrated.

Around the above-described photosensitive drum 1, sequentially in a rotational direction of the photosensitive drum 1, a charging apparatus 2 for charging evenly a surface of the photosensitive drum 1, an exposing apparatus for forming a static latent image on the photosensitive drum 1 by radiating a laser beam based on an image information, the developing unit 4 for developing the latent image as a toner image by attaching toner to the latent image on the photosensitive drum 1, an intermediate transfer unit 5 as a second image bearer on which the toner image on the photosensitive drum 1 is primarily transferred, and the like are disposed.

The developing unit 4 for developing the static latent on the photosensitive drum 1 has four developing apparatus, i.e., 4BK, 4Y, 4M, and 4C, containing four color toners and these developing apparatus, 4BK, 4Y, 4M, and 4C, are disposed concentrically around a rotating shaft 4*a*. In respective developing apparatus, 4BK, 4Y, 4M, and 4C, the developing rollers 4*b* are respectively disposed to bear toner, which is the developer, on the surface thereof and to be positioned opposite to the photosensitive drum 1 when the developing apparatus, 4BK, 4Y, 4M, and 4C, are faced to the photosensitive drum 1. The static latent image on the photosensitive drum 1 is developed by the developing roller 4*b* to be visualized as the toner image.

The above-described intermediate transfer unit 5 as a second image bearer primarily transfers the toner image on the photosensitive drum 1 and then, secondarily transfers the toner image to the surface of the transferring material S fed to the intermediate transfer unit 5. The transferring material S is carried from a cassette 14 to the intermediate transfer unit 5 by carrying means in predetermined timing.

In the image forming apparatus A, the fixing apparatus 8 is disposed to fix the toner image to the transferring material S by heating toner on the transferring material S after secondary transfer. The transferring material S passed through the fixing apparatus 8 is discharged to a sheet discharging tray 10 by a carrying unit 9. The fixing apparatus 8 has a fixing roller 8*a* and a pressing roller 8*b*, which are a pair of rolling bodies, and by passing the transferring material S bearing the toner image between the fixing roller 8*a* and the pressing roller 8*b* with the surface of the fixing roller 8*a* heated to a predetermined temperature by a heater (not illustrated) in the fixing roller 8*a*, heats and presses the transferring material S to fix the toner image to the transferring material S. The heater may be disposed inside the pressing roller 8*b*.

In this embodiment, the static latent image is developed by electrostatic adsorption of toner to the photosensitive drum 1. In case of a monochromatic color image forming apparatus, there is single developing apparatus, the intermediate transfer unit is not necessary, and the toner image is directly transferred from photosensitive drum bearing a developed image to the transferring material.

<Embodiment 1>

Figure 2:
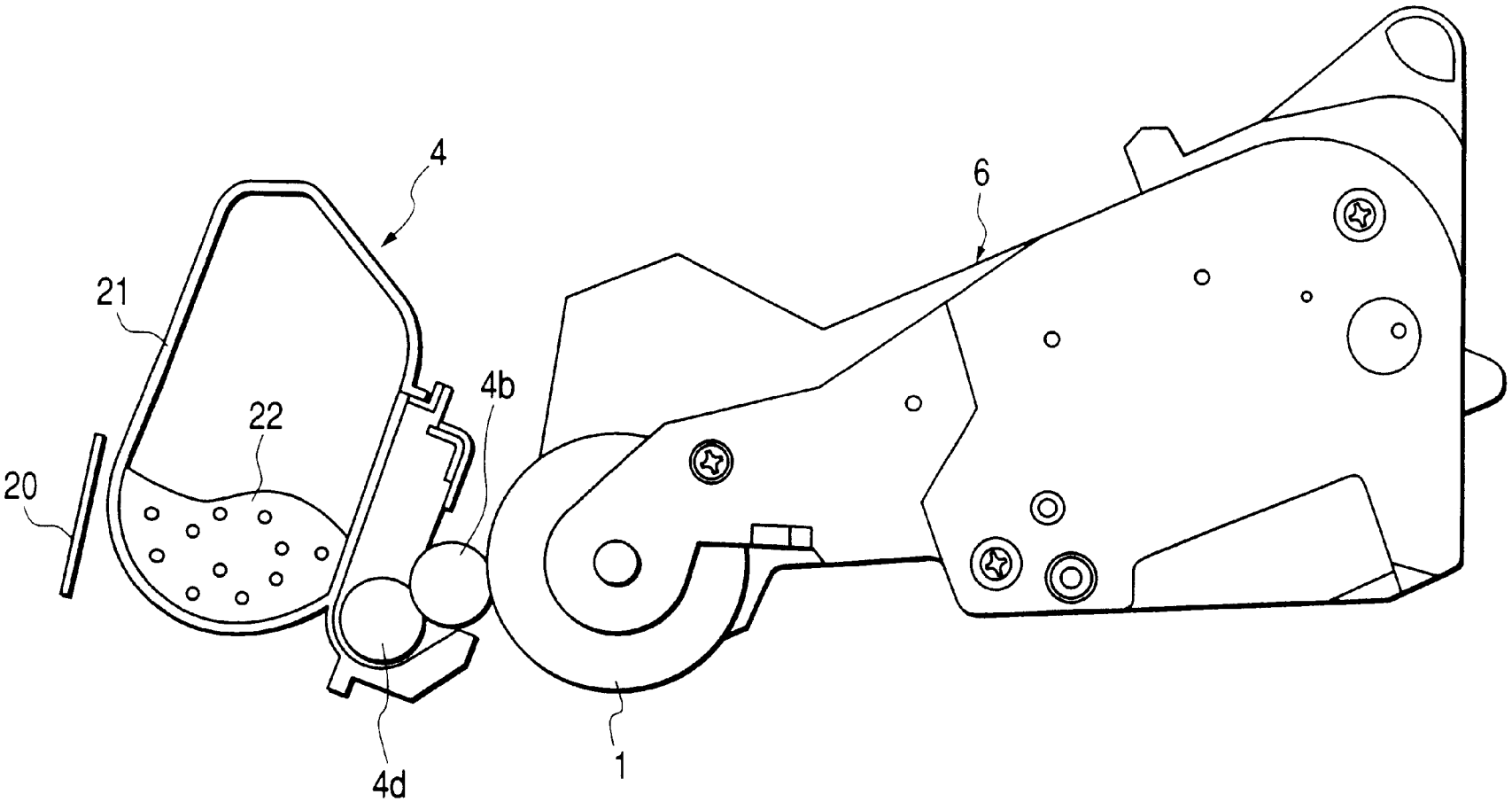
FIG. 2 is a side view of a developing apparatus and a photosensitive drum unit of a monochromatic color image forming apparatus according to embodiment 1 of the present invention.

Embodiment 1 according to the present invention will be described with reference to FIG. 2. FIG. 2 is a side view of a developing apparatus and a photosensitive drum unit of a monochromatic color image forming apparatus.

The photosensitive drum unit 6 shown in FIG. 2 has the photosensitive drum 1 as an image bearer and in developing the static latent image formed on the photosensitive drum 1, unused toner 22 contained in the toner container 21 of the developing unit 4 is rotatively carried to the developing roller 4*b* by the carrying roller 4*d* to make toner 22 to be electrostatically adsorbed to the surface of the developing roller 4*b* by applying voltage to the developing roller 4*b*. And, to the photosensitive drum 1 opposed to the developing roller 4*b*, the voltage is applied to generate an adsorbing force larger than the electrostatic adsorbing force of the developing roller 4*b*. As a result, by a bias formed by the photosensitive drum 1 and the developing roller 4*b*, toner on the developing roller 4*b* is transferred to the photosensitive drum 1.

Now, the detection method for the residual toner amount will be described below.

By the voltage applied to the developing roller 4*b*, the antenna 20 disposed previously in the main body of the image forming apparatus is electrically charged to cause an electric current to flow to the main body. Between the developing roller 4*b* and the antenna 20, unused toner 22 is interposed and unused toner 22 becomes a dielectric material and hence, according to the change of residual amount of the unused toner 22, electric charge on the antenna 20 changes to change the electric current and voltage. Consequently; on the basis of the change of the electric current and voltage, the residual amount of the unused toner 22 can be detected. The antenna 20 comprises a linear or plate-like metal.

Therefore, according to the present invention, by disposing the antenna 20 in the main body side of the image forming apparatus, the contact point becomes unnecessary, which allows the developing apparatus to be attached and detached for toner replacement between the antenna 20 and the image forming apparatus and hence, reliability and detection precision of the contact point of a detection current are increased in detecting the residual toner amount.

<Embodiment 2>

Figure 3:
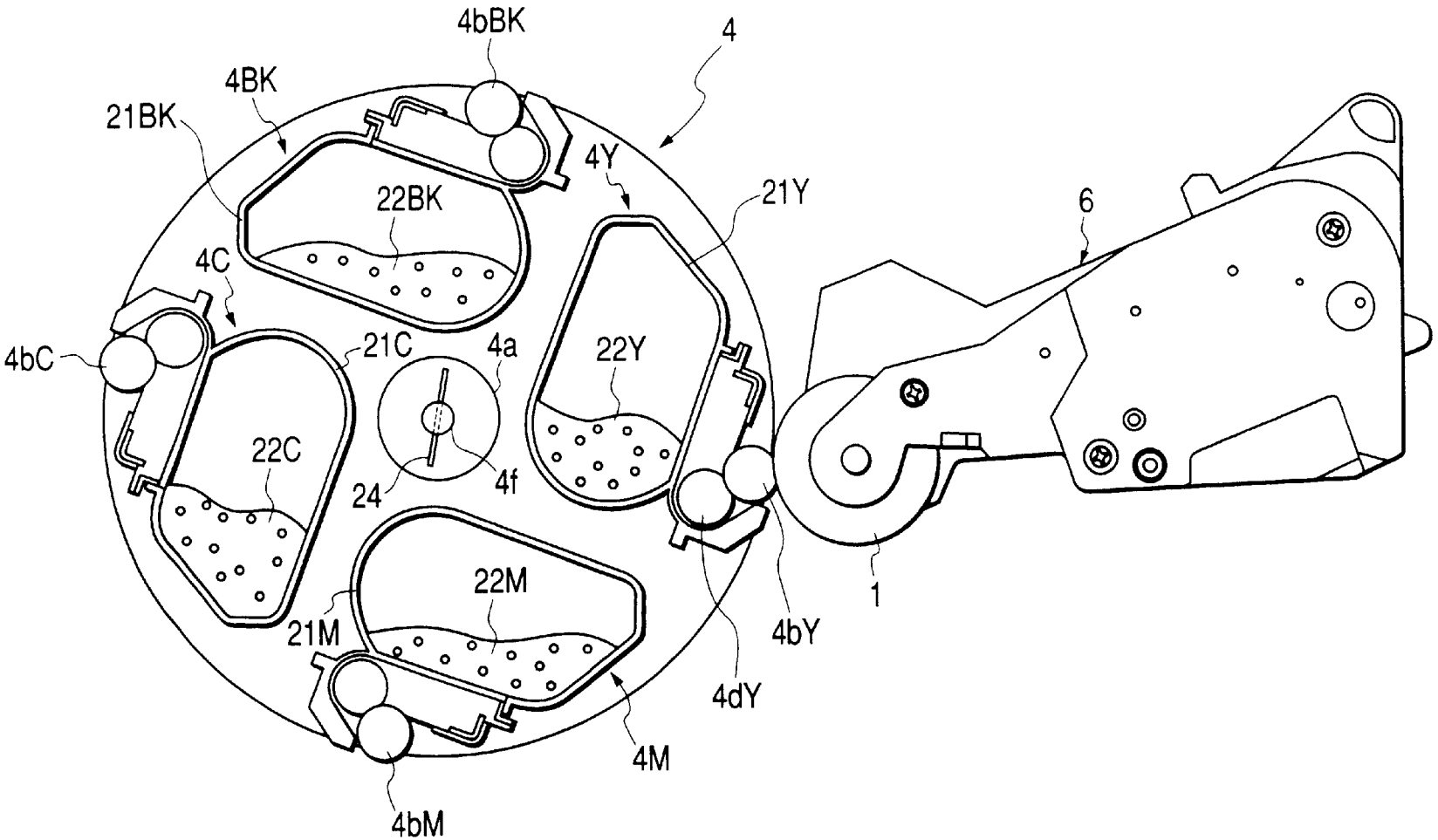
FIG. 3 is a side view of the developing unit and the photosensitive drum unit of a color image forming apparatus according to embodiment 2 of the present invention.
Figure 4:
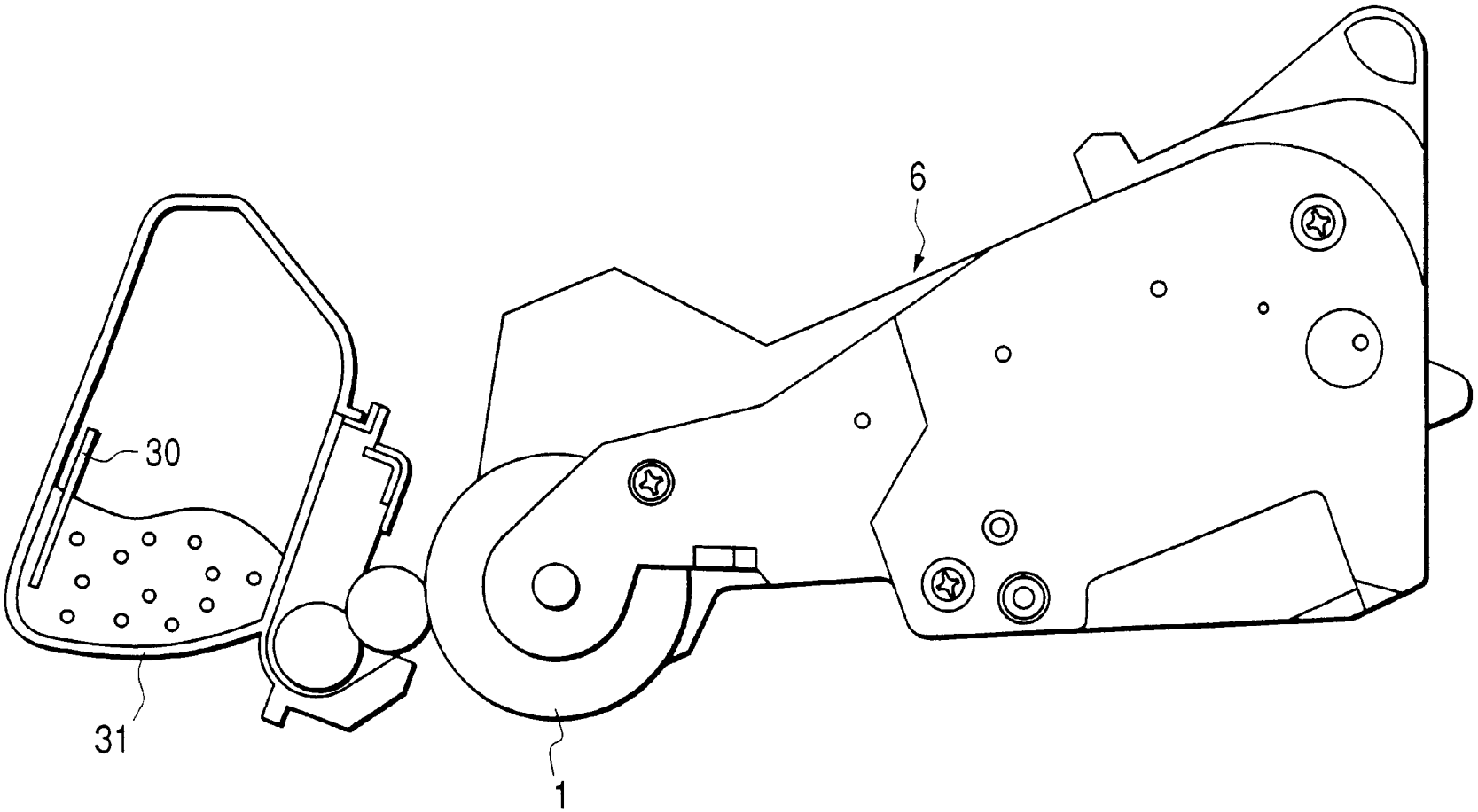
FIG. 4 is a side view of the developing apparatus and the photosensitive drum unit of the monochromatic color image forming apparatus.
Figure 5:
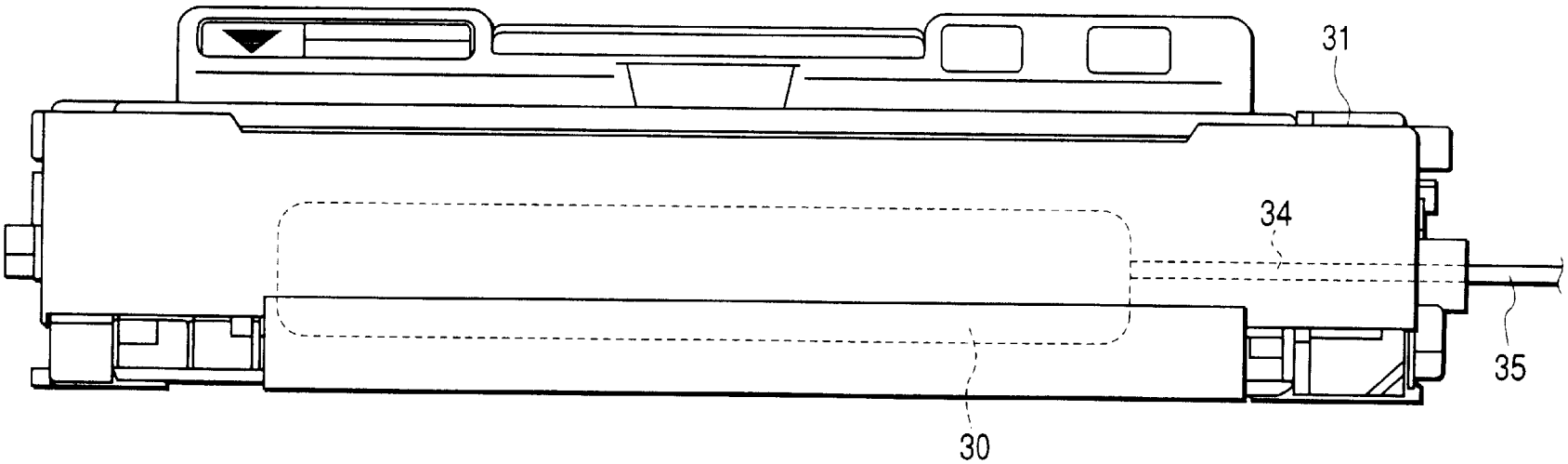
FIG. 5 is a front view of the developing apparatus of the monochromatic color image forming apparatus.
Figure 6:
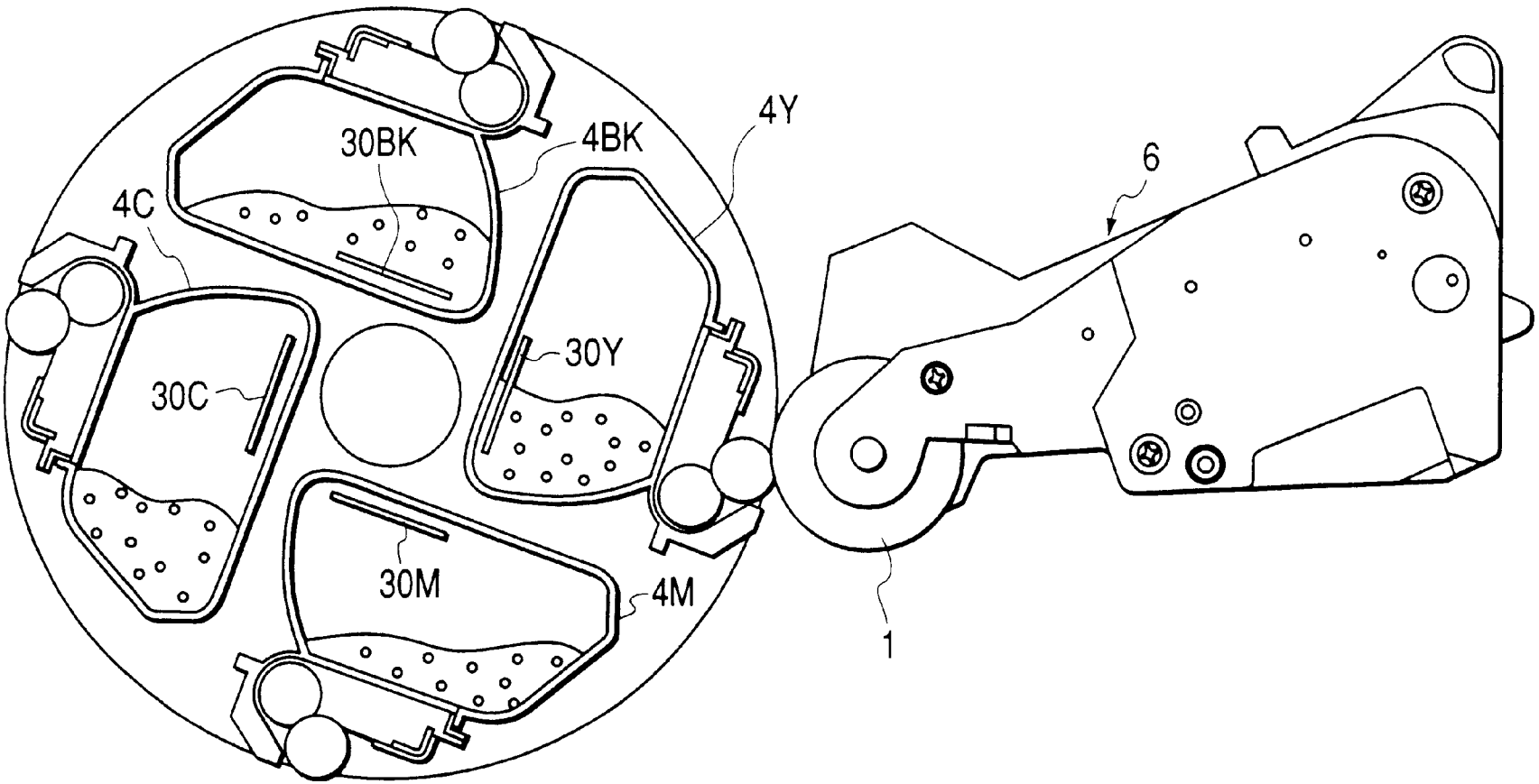
FIG. 6 is a side view of the developing unit and the photosensitive drum unit of the color image forming apparatus.

Next, The embodiment 2 according to the present invention will be described with reference to FIG. 3. FIG. 3 is a side view of the developing unit and the photosensitive drum unit of the color image forming apparatus.

In FIG. 3, reference numerals 4 and 6 denote the developing unit having a plurality of developing apparatus 4BK, 4Y, 4M, and 4C and the photosensitive drum unit having the photosensitive drum 1, respectively. Development of the static latent image on the photosensitive drum 1 in the color image forming apparatus having the developing unit 4 and photosensitive drum unit 6 is similar to the monochromatic color image forming apparatus according to the above-described embodiment 1.

For example, in the case where development is carried out by using the developing apparatus 4Y of a yellow color, unused toner 22Y contained in the toner container 21Y is rotatively carried to the developing roller 4*b*Y by the carrying roller 4*d*Y. And then, the voltage is applied to the developing roller 4*b*Y to cause toner 22Y to be statically adsorbed to the surface of the developing roller 4*b*Y. To the photosensitive drum 1 opposite to the developing roller 4*b*Y, the voltage is applied to generate the adsorbing force larger than static adsorption force of the developing roller 4*b*Y in order to transfer toner 22Y on the developing roller 4*b*Y to the photosensitive drum 1 by the bias formed by the photosensitive drum 1 and the developing roller 4*b*Y. In the developing apparatus 4M, 4C, and 4BK of magenta, cyan and black colors, respectively, the same development as above-described is carried out and in the toner containers 21M, 21C, and 21BK, 22M, 22C, and 22BK are disposed, respectively.

Subsequently, the method for detection of residual toner amount will be described below.

By the voltages applied to respective developing rollers 4*b*Y, 4*b*M, 4*b*C, and 4*b*BK, the antenna 24, disposed in the main body of the image forming apparatus, is electrically charged to make the electric current flow to the main body. Between the respective developing rollers 4*b*Y, 4*b*M, 4*b*C, and 4*b*BK and the antenna 24, unused toners 22Y, 22M, 22C, and 22BK are interposed and these kinds of unused toners 22Y, 22M, 22C, and 22BK become dielectric and hence, according to the change of the residual amount of toner, the electric charge on the antenna 24 changes to change the electric current and voltage. Consequently, on the basis of the change of the electric current and voltage, the residual toner amount of the unused toners 22Y, 22M, 22C, and 22BK can be detected.

Therefore, in the case of this color image forming apparatus where selection and switching of a plurality of the developing apparatus, 4Y, 4M, 4C, and 4BK is performed by a rotational mechanism, by disposing the antenna 24 in a center 4f of the rotating shaft 4*a*, the contact point becomes unnecessary which allows the developing apparatus 4Y, 4M, 4C, and 4BK to be attached and detached for toner replacement, between the antenna 24 and the image forming apparatus and hence, as with the above described embodiment 1 reliability and detection precision of the contact point of detection current are increased in detecting the residual toner amount.

In addition, installing the single antenna 24 in the center 4*f* of the rotating shaft 4*a* simply allows for detection of residual toner in the plurality of developing apparatuses and hence reduction of a number of the antenna.

The embodiments above described should be considered in all respects as illustrative and not restrictive; any modification can be made within the technical concept.

What is claimed is:

1. An image forming apparatus comprising:

an image bearing member for bearing an electrostatic image;

a developing apparatus for developing the electrostatic image on the image bearing member with developer, said developing apparatus including a developing chamber having a developing roller for carrying the developer and a containing chamber for containing the developer to be supplied to said developing chamber, said developing apparatus being detachably attached to an assembly of said image forming apparatus;

a detecting electrode disposed outside said developing apparatus and inside the assembly of said image forming apparatus, and in which a voltage is induced; and detection means for detecting an amount of the developer in said containing chamber on the basis of the induced voltage in said detection electrode, wherein said image forming apparatus is provided with a plurality of said developing apparatuses and with a developing unit for rotatably supporting said plurality of said developing apparatuses, and wherein said detecting electrode is arranged in a vicinity of a rotational center of the developing unit.

2. The image forming apparatus according to claim 1, wherein said detection electrode is common to said plurality of said developing apparatuses.

* * * * *

UNITED STATES PATENT AND TRADEMARK OFFICE

CERTIFICATE OF CORRECTION

PATENT NO. : 6,501,915 B2 
DATED : December 31, 2002
INVENTOR(S) : Hidetoshi Yamashita It is certified that error appears in the above-identified patent and that said Letters Patent is hereby corrected as shown below:

Title page, Item [54] and Column 1, line 3,
"DEVELOPING" should read -- DEVELOPING APPARATUS --.

Column 2,
Line 29, "developing" should read -- developing apparatus --; and
Line 30, developer" should read -- developing --.

Column 4,
Line 32, "quently;" should read -- quently, --.

Column 5,
Line 13, "apparatus," should read -- apparatus --.

Signed and Sealed this

Sixteenth Day of September, 2003

JAMES E. ROGAN
*Director of the United States Patent and Trademark Office*